United States Patent [19]

McSherry et al.

[11] 4,118,910

[45] Oct. 10, 1978

[54] ANCHORABLE TUBULAR DEVICE

[76] Inventors: Thomas McSherry, 404 Terrace Rd., Bayport, N.Y. 11705; Edward J. Gormley, 63 Guy St., Harrington Park, N.J. 07640

[21] Appl. No.: 824,584

[22] Filed: Aug. 15, 1977

Related U.S. Application Data

[63] Continuation of Ser. No. 690,213, May 26, 1976, abandoned.

[51] Int. Cl.[2] ..... E04B 1/41

[52] U.S. Cl. ..... 52/699; 52/704; 85/72

[58] Field of Search ..... 52/699, 701, 704, 707; 85/72, 73, 84, 82

[56] References Cited

U.S. PATENT DOCUMENTS

| | | | |
|---|---|---|---|
| 2,542,144 | 2/1951 | Kearns | 85/72 |
| 2,657,894 | 11/1953 | Sklenar | 85/72 |
| 2,921,819 | 1/1960 | Rifkin | 85/82 |
| 3,116,528 | 1/1964 | Poe | 85/84 |
| 3,616,591 | 11/1971 | Bahr | 52/701 |
| 3,739,684 | 6/1973 | Vitkevich | 85/73 |
| 3,798,866 | 3/1974 | Werstein | 52/707 |
| 3,896,599 | 7/1975 | Werstein et al. | 52/704 |

FOREIGN PATENT DOCUMENTS

| | | | |
|---|---|---|---|
| 445,206 | 2/1968 | Switzerland | 85/73 |

*Primary Examiner*—James L. Ridgill, Jr.
*Attorney, Agent, or Firm*—Nolte and Nolte

[57] ABSTRACT

A tubular device which is anchorable to a plate member comprises a first part including a tubular sleeve having resilient legs formed on one end thereof and an annular flange separating the legs from the rest of the sleeve and a second part comprising a tubular actuating member received in the sleeve. The tubular actuating member has a tapered end adjacent the legs. The tubular device is adapted to be received in a bore through a plate member whereupon the actuating member may be urged into engagement with the legs whereby the actuating member spreads the legs, causing the plate member to be gripped between the legs and the annular flange. The actuating member may be left in engagement with the legs, thereby to hold the legs in the spread configuration. Alternatively, after the tubular device is placed in a bore through a plate member, an elongated member which is to be fastened to the plate member by means of the tubular device may be inserted into the tubular device through the end of the sleeve remote from the legs and used to push the actuating member out of the sleeve through the other end of the sleeve whereby the actuating member spreads the legs, causing the plate member to be gripped between the legs and the annular flange.

8 Claims, 13 Drawing Figures

ANCHORABLE TUBULAR DEVICE

This is a continuation, of application Ser. No. 690,213 filed May 26, 1976 now abandoned.

BACKGROUND OF THE INVENTION

This invention relates to a tubular device which is anchorable to a plate member. More particularly, this invention relates to a tubular device in two parts and which is particularly adapted to be anchored to plate members. The invention will be described hereinbelow generally in cases in which the plate member is the decking of a building onto which decking concrete is to be poured. It is to be understood, however, that these are simply exemplary applications of the invention rather than limitations on the utility of the invention.

In the construction of buildings which are fabricated at least partly of concrete, concrete is poured on corrugated steel decking to form the floors of the building. Provision must be made for the suspending of elongated members from the underside of each floor of the building. As a particular example, it is noted that water pipes are conventionally suspended from the ceiling, that is, from the underside of the floor above. Consequently, before the concrete is poured, elongated members extending through bores in the decking are fastened to the decking. Appropriate fasteners are necessary to hold the elongated members in place pending the pouring of the concrete, while the concrete is being poured and during the setting of the concrete. The set concrete permanently anchors the elongated members. From the elongated members, threaded rods, pipe hangers and the like may be suspended.

The fasteners presently used for the aforementioned purpose consist either of a variety of jobsite fabricated assemblies which are time-consuming to construct and inconsistent in performance; or several commercially manufactured fasteners which as compared with the present invention are relatively expensive. The improved fastener of the present invention reduces to a minimum jobsite assembly, installation time and fastener cost; and provides a more secure and firm means of locking to the decking than the other means and devices currently being used.

While the devices of the invention are being described herein in particular connection with use in corrugated steel floor decking onto which concrete is to be poured, it will readily be appreciated from the below detailed description that the devices of the invention can have utility whenever an elongated member is to be attached to a plate member, or wherever provision needs to be made for "sleeving" a plate member, i.e., providing a passage through the plate member. The term "plate member" is intended to encompass any material (wood, steel, fiberglass, plaster, laminates, composite board, etc.) through which the device of the invention is inserted to position an elongated member at a right angle or provide a sleeve, i.e., a conduit, at a right angle to the plate member. The terms "conduit" and "sleeve" as used herein are intended to mean the same thing, namely, means providing a passage.

The tubular device of the invention comprises a first part including a tubular sleeve having resilient legs formed on one end thereof and an annular flange separating the legs from the rest of the sleeve and a second part comprising a tubular actuating member received in the sleeve. The tubular actuating member has a tapered end adjacent the legs. The tubular device is adapted to be received in a bore through a plate member whereupon an elongated member which is to be anchored to the plate member by means of the tubular device may be inserted into the tubular device through the end of the sleeve remote from the legs and used to push the actuating member out of the sleeve through the other end of the sleeve. Thereby, the actuating member spreads the legs, causing the plate member to be gripped between the legs and the annular flange and the elongated member then holds the legs in the spread configuration.

When a tubular device of the invention is to be used as a conduit, a second actuating member inserted in an inverted position can be used to urge the first actuating member against the legs to spread the legs sufficiently to cause the plate member to be gripped between the legs and the annular flange. The second actuating member may or may not have a sealed end and the function of the second actuating member may also be embodied within the first actuating member. If the second actuating member or its embodiment in the first actuating member comprises a sealed end, at the time that the sealed end would no longer be required, it would be cut or broken off to form a conduit, through which may be passed electrical wiring, water or steam pipes, or the like.

BRIEF DESCRIPTION OF THE DRAWINGS

The invention will now be further described by reference to specific embodiments as illustrated in the drawings, in which.

DESCRIPTION OF THE PREFERRED EMBODIMENTS

Figure 1:
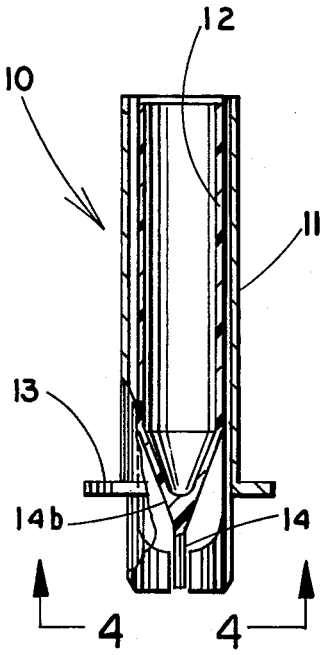
FIG. 1 is an axial cross section of a tubular device according to the invention.

With reference to FIG. 1, it is seen that the tubular device 10 of the invention comprises a tubular sleeve 11 and a tubular actuating member 12. The tubular sleeve 11 has an annular flange 13. Below the annular flange 13, the tubular sleeve 11 is split into four legs, **13*a*, 13*b*,**

13*c* and 13*d*. In principle, any plural number of legs may be employed. The legs are resilient because the device 10 is made of plastic. However, in the case of a metal device 10, the legs may also be resilient (e.g., made of a material with natural or imparted spring tension). Typical plastics that may be used for the sleeve 11 and the actuating member 12 are polypropylene, polyethylene, nylon, polyoxymethylene resins and the like. The same plastics or preferably a strong metal such as steel may be used for the optional third part, to be discussed below. The actuating member 12 is provided with an end 14 assembled adjacent the legs 13*a*, 13*b*, 13*c* and 13*d*. The end 14 may have a conical terminus as shown in phantom in FIG. 3 at 14*a* but in any event is preferably of minor dimensions for keeping the legs 13*a*, 13*b*, 13*c* and 13*d* from being squeezed together to form a block against the leg opening operation of actuating member 12, when the legs are thrust through a plate opening, to be described. The end 14 in the preferred embodiment is cylindircal and extends to a conical portion 14*b* which urges the legs 13*a*, 13*b*, 13*c* and 13*d* apart when the actuating member is pushed downwards.

Figure 2:
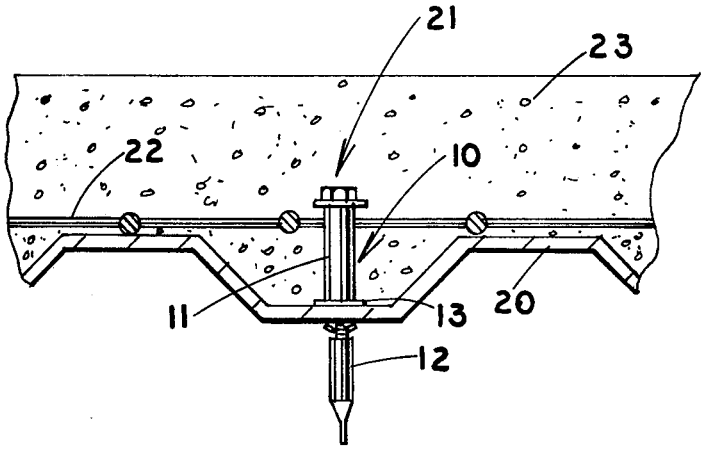
FIG. 2 is a cross section of steel decking in which the tubular device of FIG. 1 has been installed and over which concrete has been poured.
Figure 3:
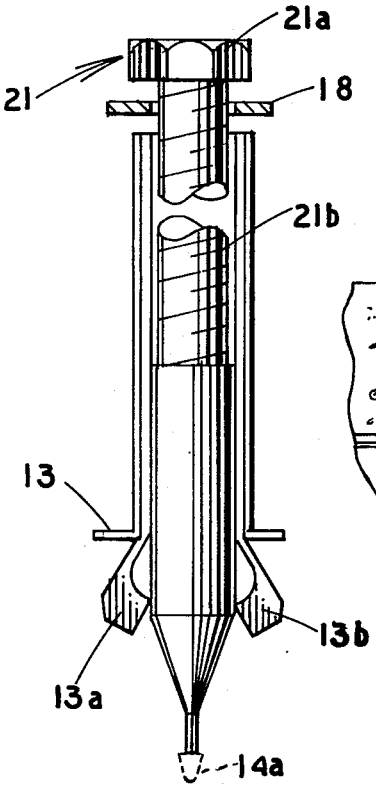
FIG. 3 is an elevation, partly in section, of the tubular device of FIG. 1 showing a bolt, part of the length of which has been omitted for convenience of illustration, in the process of being inserted therein.
Figure 4:
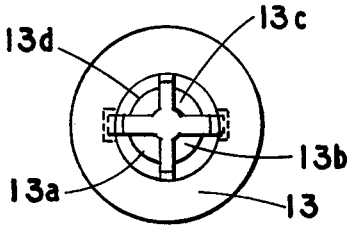
FIG. 4 is an end view of the tubular device of FIG. 1 taken on line 4—4 of FIG. 1.

FIG. 2 illustrates the device of FIG. 1 installed on a decking with concrete poured thereon. The corrugated steel decking 20 is formed with a bore in which the device 10 is inserted, with the flange 13 of the device resting on the top surface of the decking 20. A bolt 21 having a hex head 21*a* and an externally threaded shank 21*b* of slightly smaller diameter than the internal diameter of the actuating member 12 so as to snugly engage in the actuating member 12 is inserted into the sleeve 11 and the actuating member 12 so as to force the actuating member 12 downward between the legs 13*a*, 13*b*, 13*c* and 13*d*. A washer 18 is also provided. As shown in FIG. 3, as the bolt 21 is pushed downwards the actuating member 12, with the assistance of its tapered portion 14*c*, spreads the legs 13*a*, 13*b*, 13*c* and 13*d* apart. Eventually, the actuating member 12 passes out of engagement with the legs 13*a*, 13*b*, 13*c* and 13*d* and the shank 21*b* of the bolt 21 itself holds the aforementioned legs in the spread position, in which the decking 20 is gripped between the aforementioned legs and the annular flange 13, thereby to hold the sleeve 11 rigidly in an upright position with the bolt extending therethrough and the actuating member 12 received on the end of the shank 21*b* of the bolt. The actuating member 12 may be left on the shank 21*b* of the bolt until one is ready to attach something, such as a pipe hanger, thereto, and in this way the actuating member 12 may be used to protect the shank 21*b* of the bolt. Whenever desired, the actuating member 12 may simply be manually pulled off the shank 21*b* of the bolt. According to conventional practice, before or after the fasteners and bolts are in place, a wire mesh 22 is laid on the decking 20 and then the concrete 23 is poured.

Figure 5:
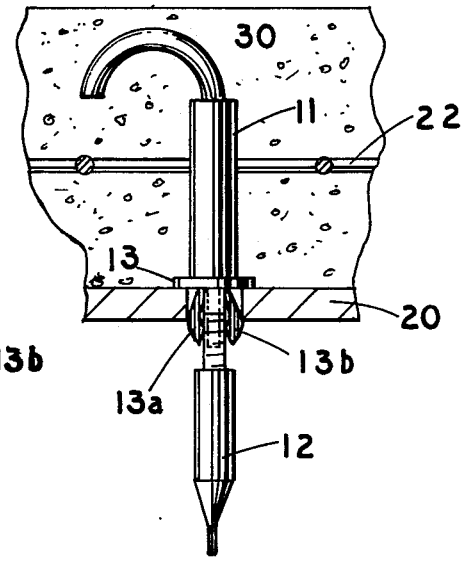
FIG. 5 is similar to FIG. 2 but with a different elongated member inserted in the tubular device.

FIG. 5 is similar to FIG. 2, but, here, a J-bolt 30 has been used.

Figure 6:
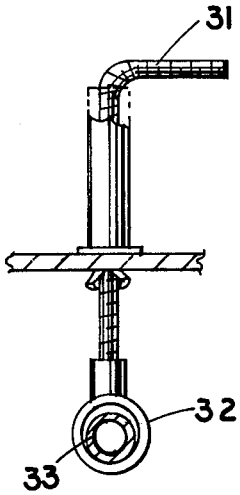
FIG. 6 shows the tubular device used in connection with a threaded rod from which a pipe hanger is suspended.

In FIG. 6, in which the concrete and mesh have been eliminated for simplicty of illustration, a piece of bent threaded rod 31 has been substituted for the J-bolt 30. Moreover, the ultimate utility of the fastener is illustrated by a pipe hanger 32 screwed onto the threaded rod 31 and supporting a water pipe 33.

Figure 7:
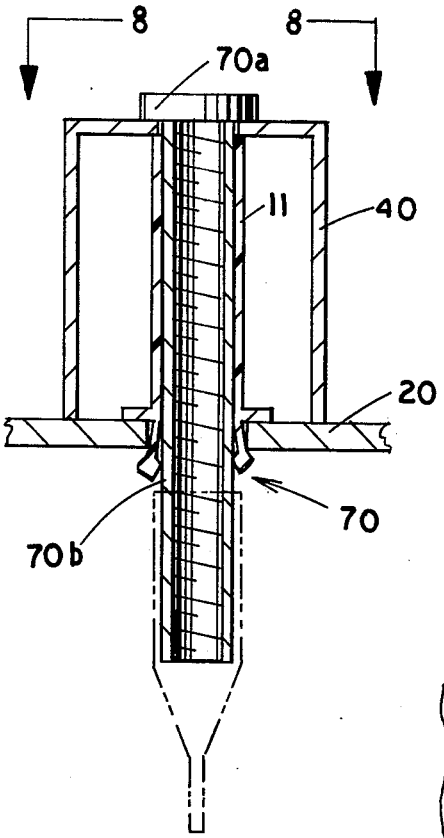
FIG. 7 is an axial section of another embodiment of the tubular device according to the invention.
Figure 8:
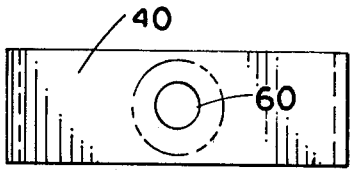
FIG. 8 is a plan view of the tubular device of FIG. 7 taken on line 8—8 of FIG. 7.

In FIGS. 7 and 8, another aspect of the invention is shown. In some instances, it is important to provide means for distributing a load imposed on the head of the fastener, or any elongated member, over a greater cross-sectional area of the concrete and/or the plate member in order to prevent the fastener and/or the elongaed member from moving axially in the direction of the imposed load. The weight of a large diameter water pipe 33 in FIG. 6 is typical of such a load. To this end, there is provided in accordance with the invention an optional third part of the fastener. This third part may be characterized as being in the form of a concave member which is partly open laterally of its concavity. In this respect, the term "concavity" is not used in a strictly mathematical sense. The sense in which "concavity" is used in the present invention encompasses table-like structures as well as conventional concave structures. However, in all instances, the structure must be partly open laterally of its concavity, which is true of a table-like structure. In other words, when the concave member is placed on the decking, the fact that the member is partly open laterally of its concavity will permit the concrete to fill the concavity. Member 40 in FIGS. 7 and 8 is an example of a concave member according to the invention.

It will be noted that in this embodiment the concave member is of sufficient depth in its concavity to bridge the tubular sleeve 11 of the device 10 when placed on the plate member 20. Moreover, an aperture 60 (FIG. 8) is provided in the concave member for axial alignment with the sleeve, the aperture being of sufficiently great diameter to permit passage of the shank of the bolt but of sufficiently small diameter to engage the head of the bolt thereby to distribute a load applied to the head away from the head over a greater cross-sectional supporting area. FIG. 7 has also been utilized to show a different bolt. Here, the bolt 70 has a head 70*a* in the form of a disc and a shank 70*b* in the form of an internally threaded hollow tube. It can readily be appreciated that a piece of threaded rod may be screwed into the shank 70*b* and then a desired device such as a pipe hanger may be screwed onto the other end of the threaded rod.

Figure 9:
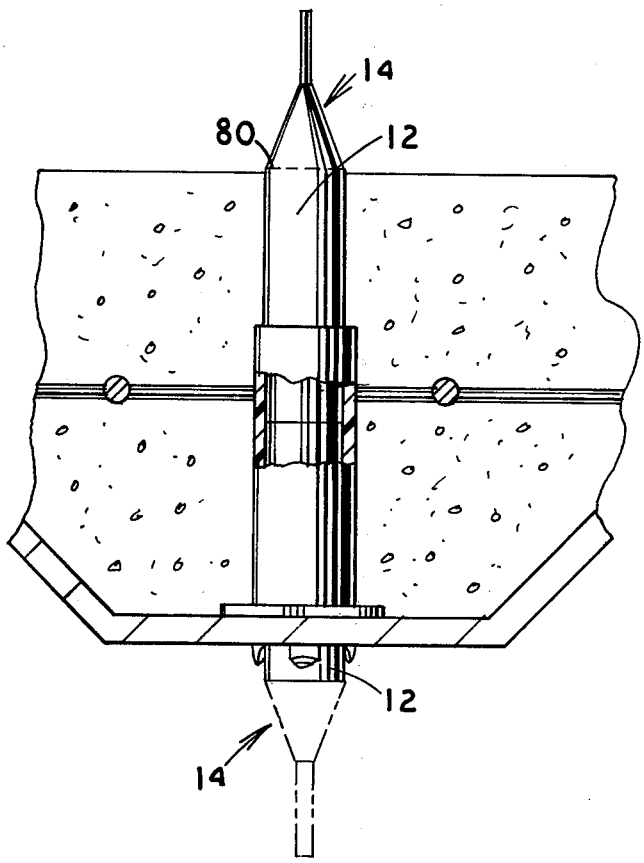
FIG. 9 is similar to FIGS. 2 and 5 but shows still another embodiment of the invention.

FIG. 9 shows an embodiment of the invention in which the tubular device is provided with two actuating members 12 and 12'. Otherwise, the device is like that of FIG. 1. It is initially put in place the same way as the device of FIG. 1, but with the cylindrical ends of the second actuating member 12' abutting the cylindrical end of the first actuating member 12 and the end 14 including the conical portion of the first actuating member 12 having been forced past the legs before the concrete is poured. The respective ends 14 and 14' are broken or cut off so that a conduit is left through the concrete and the decking. The conduit may be used, for example, as a passage for wiring or plumbing. The end 14 is shown in phantom so one can more readily appreciate that the device does indeed define a conduit when the ends of the actuating members are removed. Perforations 80 are shown between the end 14' and the rest of the actuating member 12'. The other actuating member could likewise be fabricated with perforations. This facilitates breaking off the tapered end 14'. However, this is merely optional.

Figure 10:
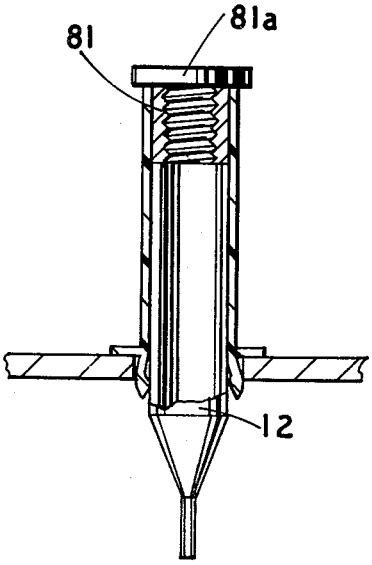
FIG. 10 is an elevation, partly in section and partly broken away, of another embodiment of the invention.

In the embodiment of FIG. 10, actuating member 12 may be pushed down to lock the device in the bore by means of a female threaded coupling member 81 connected to a fastener 81*a* comprised of an externally threaded shank and head in the form of a disc of greater diameter than the outer diameter of the tubular sleeve (11 FIG. 1).

Figure 11:
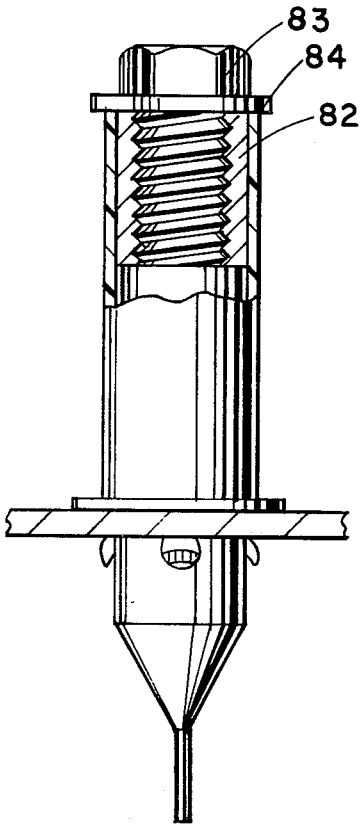
FIG. 11 is similar to FIG. 10 but shows yet another embodiment of the invention.

The embodiment of FIG. 11 is quite similar to that of FIG. 10 except that here there is provided a female coupling member 82 without an annular flange, a hex head bolt 83 engaging the coupling member over half the axial length of the latter and a washer 84. Again, the actuating member 12 is then pulled out entirely. A male threaded member may be inserted to engage the threads in the remaining half of the axial length of the coupling member 82.

Figure 12:
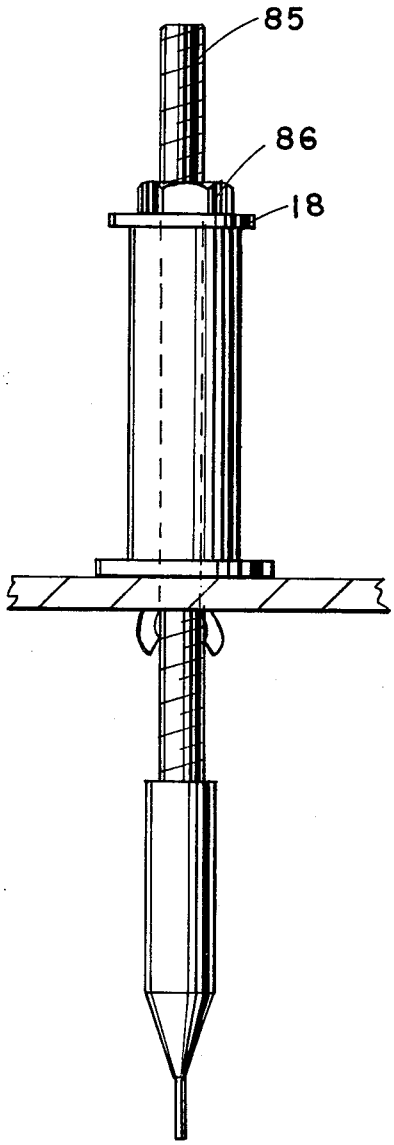
FIG. 12 is an elevation of another embodiment of the invention.

The embodiment of FIG. 12 is similar to that of FIG. 2 but here a length of threaded rod 85 and a hex nut 86 take the place of the bolt 21. As in FIG. 2, a washer 18 is provided.

Figure 13:
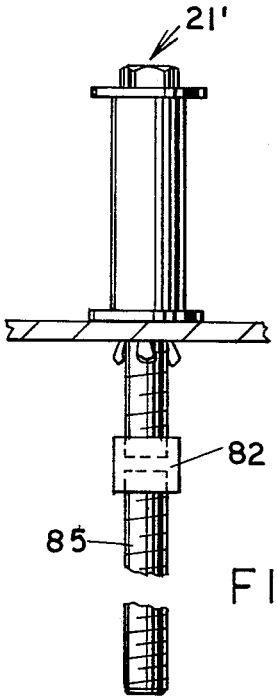
FIG. 13 is an elevation of still another embodiment of the invention.

The FIG. 13 embodiment is like the FIG. 2 embodiment but the hex head bolt 21' is longer than the hex head bolt 21. Here, the female threaded coupling member 82 is used to attach threaded rod 85 to the bolt 21'. The FIG. 13 embodiment will generally be preferred over the FIG. 12 embodiment because the former does not require a separate coupling member or bolt, involves less labor for installation and provides for length adjustment during installation.

What is claimed is:

1. A device for anchoring to a building deck atop which concrete is poured and for providing conduit means for a separate fastener or the like through the concrete and through a bore in the deck and for providing temporary anchorage for the device or for the fastener or the like, while the concrete is poured and hardening, said device comprising a tubular sleeve having resilient legs formed on the bottom end thereof and an annular flange separating said legs from the upper portion of the sleeve, said upper portion of said sleeve extending a substantial distance from said flange to the top end, said device further comprising an elongated actuating member received in the sleeve, said legs of said sleeve being adapted to closely pass through the bore in the deck, said actuating member comprising means, when urged into engagement with said legs, for spreading said legs to cause the deck to be gripped between said legs and said annular flange as long as the actuating member or other elongated member is maintained in engagement with the legs, said actuating member having a top portion constituting means for being driven and for completely passing through said sleeve from said top end through said bottom end thereof, said sleeve constituting the conduit means through the concrete and through the bore for the fastener or the like.

2. A tubular device according to claim 1, in which said sleeve constitutes means for holding an elongated member at a 90° angle perpendicular to the deck.

3. A tubular device according to claim 1 in which said tubular sleeve constitutes means for holding a second tubular sleeve for providing conduit means through the deck.

4. A tubular device according to claim 1 in which said elongated actuating member is also tubular having an end adjacent said legs and an open end opposite said first mentioned end, said open end comprising means for receiving another elongated member whereby said actuating member may be driven past said legs by the other elongated member, said tubular sleeve constituting means for anchoring the other elongated member to the deck.

5. A tubular device according to claim 1, further comprising a third part in the form of a concave member of sufficient depth in its concavity to bridge the tubular sleeve when placed on the plate member, an aperture being formed through the concave member for axial alignment with the sleeve and of sufficiently great diameter to permit passage of the shank of an elongated member having a head and a shank, said elongated member to be anchored to the deck by means of the tubular device and the aperture also being of sufficiently small diameter to engage the head of the elongated member thereby to distribute a load applied to the head away from the head.

6. A tubular device according to claim 1 in which said elongated actuating member includes an end adjacent said legs, said end comprising means for retaining said legs apart when said legs are passed through the plate bore.

7. A tubular device according to claim 6 in which said end is tapered.

8. A tubular device according to claim 6 in which said end extends from adjacent said legs to a tapered portion, said tapered portion constituting said spreading means.

* * * * *